US007364280B2

(12) United States Patent
Miyazawa et al.

(10) Patent No.: US 7,364,280 B2
(45) Date of Patent: Apr. 29, 2008

(54) IMAGE RECORDING APPARATUS AND BOTTLE HOLDER

(75) Inventors: Takashi Miyazawa, Hachioji (JP); Masashi Matsuda, Hachioji (JP)

(73) Assignee: Olympus Corporation, Tokyo (JP)

( * ) Notice: Subject to any disclaimer, the term of this patent is extended or adjusted under 35 U.S.C. 154(b) by 382 days.

(21) Appl. No.: 11/107,512

(22) Filed: Apr. 15, 2005

(65) Prior Publication Data

US 2006/0232643 A1 Oct. 19, 2006

(51) Int. Cl.
*B41J 2/175* (2006.01)

(52) U.S. Cl. ..... 347/85

(58) Field of Classification Search ..... 347/5, 347/7, 19, 49, 85; 141/2, 18
See application file for complete search history.

(56) References Cited

U.S. PATENT DOCUMENTS 6,412,911 B1 * 7/2002 Hilton et al. ..... 347/49
6,905,434 B2 * 6/2005 Sugihara et al. ..... 475/276
6,991,325 B2 * 1/2006 Oda et al. ..... 347/85
7,008,052 B2 * 3/2006 Yamada et al. ..... 347/85

FOREIGN PATENT DOCUMENTS

JP 2002-113880 A 4/2002
JP 2003-127416 A 5/2003

* cited by examiner

*Primary Examiner*—Anh T. N. Vo
(74) *Attorney, Agent, or Firm*—Frishauf, Holtz, Goodman & Chick, P.C.

(57) ABSTRACT

A bottle holder of an image recording apparatus, which holds removably an ink bottle including an ink outlet, has an ink outlet connecting part for connecting the ink outlet, a guide having a guide surface that contacts the ink bottle to guide the ink bottle along a predetermined axis when the ink bottle is fit, a resisting part that is provided on the bottle guide surface and contacts the ink bottle to serve as a resistor to resist the movement of the ink bottle when the ink bottle is removed along the guide axis, and an ink receiving part to receive the ink dripped from the ink outlet. The ink receiving part is located relatively to the resisting part so as to position below the ink outlet when the ink bottle contacts the resistor upon the removal.

8 Claims, 7 Drawing Sheets

IMAGE RECORDING APPARATUS AND BOTTLE HOLDER

BACKGROUND OF THE INVENTION

1. Field of the Invention

The present invention relates to an image recording apparatus having a bottle holder that removably holds an ink bottle.

2. Description of the Related Art

An image recording apparatus for recording an image by ejecting ink has been widely used. An image recording apparatus has an image recording unit to eject ink, a recording medium conveying unit to convey a recording medium, and an ink supply unit to supply ink to the image recording unit. Such a conventional image recording apparatus is disclosed in Jpn. Pat. Appln. KOKAI Publication No. 2002-113880.

The image recording apparatus disclosed in the Jpn. Pat. Appln. KOKAI Publication No. 2002-113880 comprises an ink tank containing ink as an ink supply source, an image recording unit, and an ink supply unit to connect the image recording unit to the ink tank. The ink tank has an ink supply port to connect the ink supply unit. The ink supply port is an ink outlet for flowing out the ink of the ink tank. The ink supply unit has an ink replenish port that is a connector to the ink supply port. The ink tank and ink supply unit are connected by aligning the center axes of the ink supply port and ink replenish port, and fitting them by moving to come close to each other.

The ink of the ink tank flows into the ink supply unit, when the ink supply port is connected to the ink replenish port. Thus, if the connecting force is weak or unstable so that the connection between the ink supply port and ink replenish port is accidentally released, the ink may leak out from the clearance between them. Therefore, in the image recording apparatus of the Jpn. Pat. Appln. KOKAI Publication No. 2002-113880, an annular lip portion is provided all over the internal circumference surface of the ink replenish port to increase the airtightness when the ink supply port and ink replenish port are connected. It is common to provide a member for airtightness to increase the airtightness in the connection between the ink tank and ink supply unit. As the airtightness is increased in the connection between the ink tank and ink supply unit, the connecting force is increased.

BRIEF SUMMARY OF THE INVENTION

The present invention is, in an aspect, directed to a bottle holder of an image recording apparatus, which removably holds an ink bottle having an ink outlet. A bottle holder according to the present invention comprises an ink outlet connecting part to connect the ink outlet, a guide having a bottle guide surface that contacts an ink bottle to guide the ink bottle along a predetermined guide axis when fitting an ink bottle, a resisting part that is provided on the bottle guide surface and contacts the ink bottle to serve as a resistor to resist the movement of the ink bottle when the ink bottle is removed along the guide axis, and an ink receiving part to receive the ink dripped from the ink outlet. The ink receiving part is located relatively to the resisting part so as to position below the ink outlet when the ink bottle contacts the resistor upon the removal.

The present invention is, in another aspect, directed to an image recording apparatus. An image recording apparatus according to the present invention comprises an image recording unit that records an image by ejecting ink, an ink supply unit that connects at least one ink bottle containing ink for recording an image to the image recording unit, and a control unit that controls the driving of the ink supply unit. The ink bottle has an ink outlet to flow out the ink, which has a valve that is allowed to open and close. The ink supply unit includes a bottle holder to hold the ink bottle removably, a detector to detect that the ink bottle is placed at a proper position in the bottle holder, and a valve open/close mechanism to open and close the valve of the ink outlet. The control unit drives the valve open/close mechanism to open the valve of the ink outlet of the ink bottle after a predetermined time has passed from receiving a detection signal from the detector.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained hereinafter with reference to the accompanying drawings.

Figure 1:
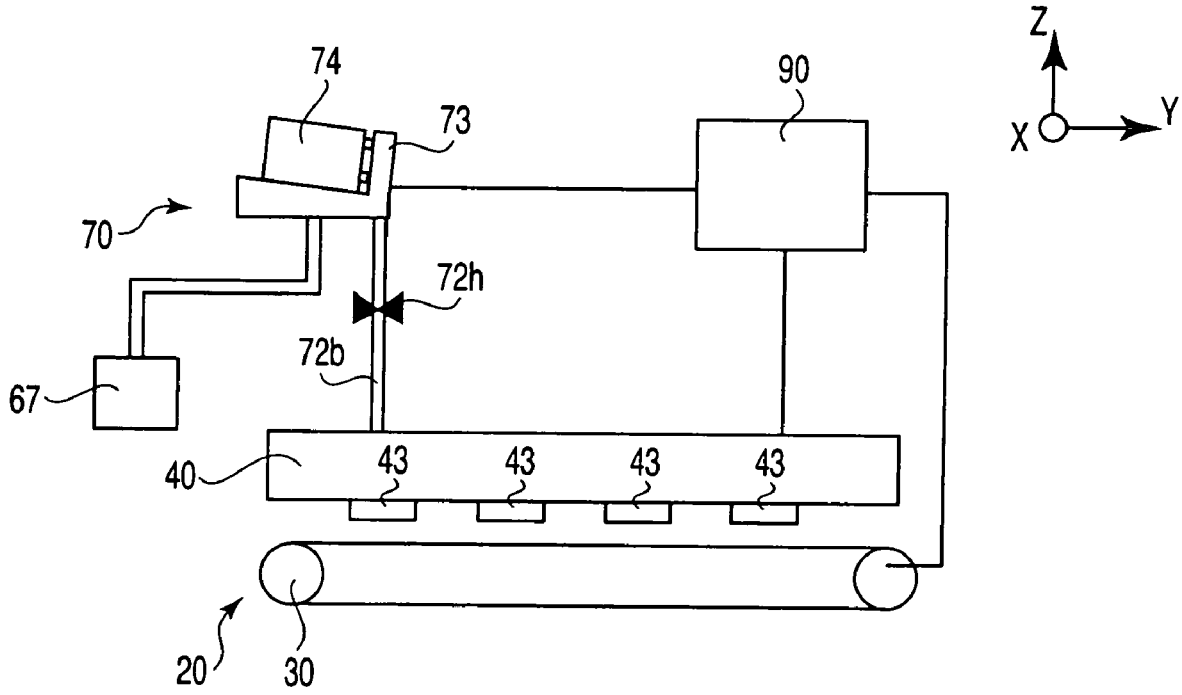
FIG. 1 is a schematic side view showing an image recording apparatus according to an embodiment of the present invention.

First description will be given on one embodiment of the present invention with reference to FIG. 1. FIG. 1 is a schematic side view showing an image recording apparatus according to one embodiment of the present invention.

An image recording apparatus 1 of this embodiment comprises an image recording mechanism 20, an ink supply unit 70, and a control unit 90.

[Image Recording Mechanism 20]

The image recording mechanism 20 comprises a recording medium conveying mechanism 30 to convey a recording medium, and an image recording unit 40 to eject ink to a recording medium. The image recording unit 40 has ink jet heads 43. The image recording unit records an image by ejecting ink from each ink jet head unit 43 to a recording medium conveyed sequentially by the recording medium conveying mechanism.

[Ink Supply Unit 70]

The ink supply unit 70 is an ink supply path to supply ink from an ink supply source to the image recording unit 20. The ink supply unit 70 has a bottle holder 73 to hold an ink bottle 74 containing ink that is an ink supply source, a connection tube 72*b* that is an ink supplying path to connect the bottle holder 73 to the image recording unit 20, a connection tube valve 72*h* to open and close the connection tube 72*b*, and a waste ink tank 67 to collect waste ink from the bottle holder.

The image recording apparatus 1 is filled with ink by setting the ink bottle 74 containing ink in the bottle holder 73.

[Ink Bottle 74 of Ink Supply Unit 70]

The ink bottle 74 for each color is placed in the corresponding bottle holder 73. In this embodiment, four ink bottles 74 for four colors are placed in the corresponding bottle holders 73. The ink bottle holder 74 is first placed at the initial position, and moved to the position to connecting position, and connected to the bottle holder 73, as explained later in the description of the bottle holder 73. The ink bottle is guided by the bottle holder 73 and moved along a bottle guide axis GD (refer to FIG. 2). At the connecting position, the ink bottle 74 is connected to the bottle connecting unit 73C (refer to FIG. 2) of the bottle holder 73.

Figure 2:
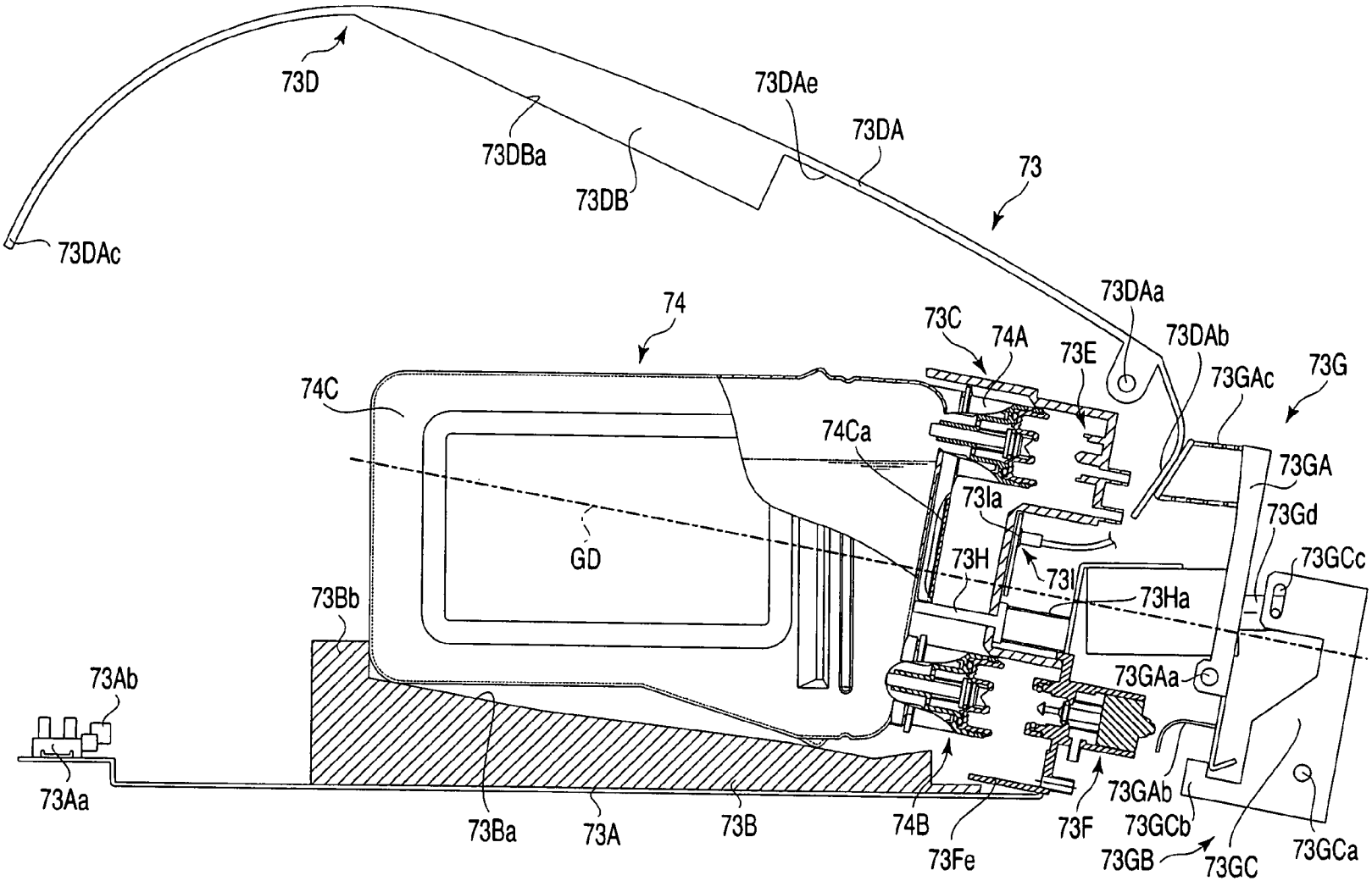
FIG. 2 is a schematic sectional view showing a bottle holder at the opened position.

Each ink bottle 74 has a bottle body 74C to store ink, a bottle vent hole 74A to vent the air in the bottle body 74C, and an ink outlet 74B to flow out the ink in the bottle body 74C, as shown in FIG. 2.

The bottle vent hole 74A and ink outlet 74B are provided on the side wall of the bottle body 74C opposite to the bottle connecting unit 73C, at the time of connection, and extended along the bottle guide axis GD. In other words, the bottle vent hole 74A and ink outlet 74B are placed in front of the bottle body 74C in the moving direction when the ink bottle is connected.

[Bottle Venthole 74A of Ink Bottle 74]

Figure 3:
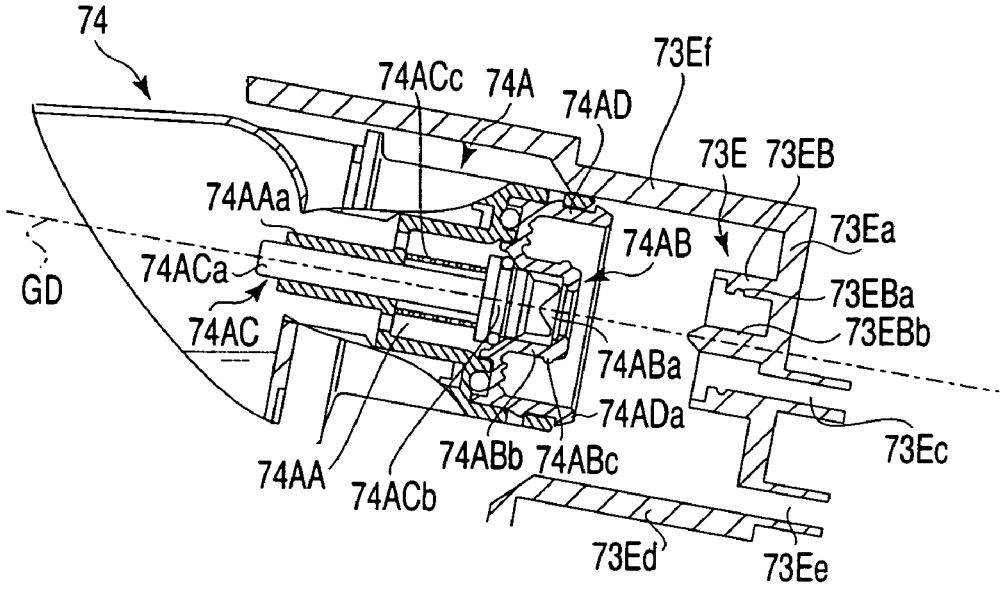
FIG. 3 is a sectional view showing a vent hole.

The bottle vent hole 74A is located above the ink bottle 74 when the ink bottle 74 is connected. As shown in FIG. 3, the bottle vent hole 74A has a bottle connecting passage 74AA to vent the air, a passage opening part 74AB to connect the bottle connecting passage 74AA to the outside, a passage valve 74AC to open and close the passage opening part 74AB, and an opening outside cover 74AD to cover the surroundings of the passage opening part 74AB.

One end of the bottle connecting passage 74AA is connected to the bottle body 74C, and the other end is connected to the outside of the ink bottle 74 through the passage opening part 74AB. In the bottle connecting passage 74AA, a passage valve holding part 74AAa is provided to hold the passage valve 74AC slidably in a predetermined direction. The passage valve holding part 74AAa guides the passage valve 74AC along the bottle guide axis GD when the bottle is connected.

The passage opening part 74AB has a passage opening 74ABa to connect the bottle connecting passage 74AA to the outside of the ink bottle 74. The passage opening part 74AB has a passage opening cover 74ABb provided along the outer circumference of the passage opening 74ABa. In other words, the substantially cylindrical passage opening cover 74ABb extends from the outer circumference of the passage opening 74ABa. The passage opening cover 74ABb is configured, so that the center axis in the length direction is located along the bottle guide axis GD when the bottle is connected. On the side of the passage opening cover 74ABb, a cover projection 74ABc is provided to fit with the passage opening part 74AB when it is completely connected to the bottle holder 73.

The passage valve AC has a sliding part 74ACa held by the passage valve holding part 74AAa, a valve member 74ACb to open and close the passage opening part 74AB, and a valve urging member to urge the valve member 74ACb.

The sliding part 74ACa has a center axis in the length direction, and has first end and second end portions along the center axis in the length direction. The first end portion of the sliding part 74ACa is held by the passage valve holding part 74AAa. Thus, the center axis in the direction of the sliding part 74ACa is aligned with a predetermined guiding direction of the passage valve holding part 74AAa. In this embodiment, the center axis in the length direction of the sliding part 74ACa becomes parallel to the bottle guide axis GD when the bottle is connected. The second end portion of the sliding part 74ACa is fixed to the valve member 74ACb. The valve member 74ACb is located at the position opposite to the passage opening 74ABa.

The valve member 74ACb is urged by the valve urging member 74Acc toward the passage opening 74ABa along the bottle guide axis GD of the passage valve holding part 74AAa. Thus, the valve member 74ACb contacts tightly the passage opening 74ABa closes the passage opening 74ABa. If the valve member 74ACb is pushed against the urging force of the valve urging member 74Acc in the guiding direction, the valve member moves to the bottle body 74C and opens the passage opening 74ABa.

The opening outside cover 74AD is formed cylindrical concentric with the passage opening cover 74ABb, and configured so that the center axis in the length direction is placed along the bottle guide axis GD when the ink bottle is connected, like the passage opening cover 74ABb. When the bottle is connected, the outside cover end 74ADa opposite to the bottle connecting unit 73C of the opening outside cover 74AD projects from the passage opening cover 74ABb in the bottle guide axis GD.

[Ink Outlet 74B of Ink Bottle 74]

Figure 4:
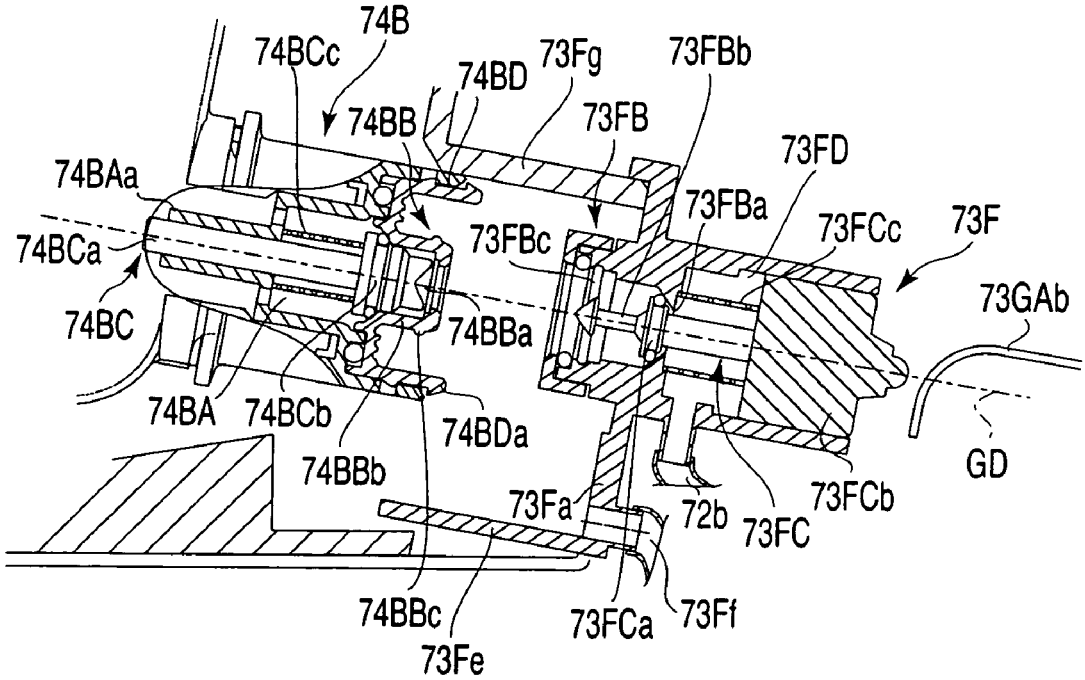
FIG. 4 is a sectional view showing an ink outlet.

The ink outlet 74B has substantially the same structure as the bottle vent hole 74A. Therefore, as shown in FIG. 4, the bottle connecting passage 74BA has the same structure as the bottle connecting passage 74AA at the ink outlet 74B. Therefore, the passage valve holding part 74BAa has the same structure as the passage valve holding part 74AAa. The passage opening part 74BB has the same structure as the passage opening part 74AB. Therefore, the passage opening 74BBa, passage opening cover 74BBb, and cover projection 74BBc have the same structure as the passage opening 74ABa, passage opening cover 74ABb and cover projection 74ABc. The passage valve 74BC is the vale of the ink outlet 74B, and has the same structure as the passage valve 74AC. Therefore, the sliding part 74BCa, valve member 74BCb and valve urging member 74BCc have the same structure as the sliding part 74ACa, valve member 74ACb and valve urging member 74ACc. The opening outside cover 74BD has the same structure as the opening outside cover AD. Therefore, the outside cover end portion 74BDa has the same structure as the outside cover end 74ADa.

[Bottle Body 74*c* of Ink Bottle 74]

The bottle body 74C has an ink label 74Ca that is an identifier to identify an ink bottle. The ink label 74Ca is a recording medium having the information such as the color of ink in the ink bottle 74. In this embodiment, the ink label 74Ca includes the information about the kind of ink stored in the ink bottle. The ink label 74Ca is configured to permit a wireless reading unit 73I to read the recorded information without contacting the label. The ink label 74Ca is stuck to a part of the bottle body 74C that is faced to the bottle connecting unit 73C when the bottle is connected.

[Bottle Holder 73 of Ink Supply Unit 70]

The bottle holder 73 is means for holding removably the ink bottle 74 containing ink. The bottle holder 73 has connecting means or a connector to connect the held ink bottle 74 to the bottle connection tube 72*b*. The bottle holder 73 is provided in the same number as the ink bottles 74 to be fit in the image recording apparatus 1. Each bottle holder 73 is constructed to hold one ink bottle. In this embodiment, four bottle holders are provided in the image recording apparatus 1 to hold four ink bottles 74.

Now, the bottle holder 73 will be explained in detail with reference to FIG. 2. The bottle h older 73 has an ink bottle guide member 73B to guide the ink bottle 74 when fitting the ink bottle, a bottle connecting unit 73C that is a connector to connect the bottle vent hole 74A and ink outlet 74B of the ink bottle 74, and a holder cover 73D to cover the ink bottle 74 when fitting the ink bottle.

[Ink Bottle Guide Member 73B of Bottle Holder 73]

The ink bottle guide member 73B is placed on the bottom 73A of the bottle holder 73. The ink bottle guide member 73B has a bottle guide surface 73Ba to guide the ink bottle 74 along a predetermined axis. In this embodiment, the bottle guide surface 73Ba guides the ink bottle 74 along the length direction of the bottle holder 73 (in the lateral direction in FIG. 2). The bottle guide surface 73Ba is inclined from the horizontal plan to the bottle connecting unit 73C, so as to move easily the ink bottle 74 filled with ink to the bottle connecting unit 73C. In this configuration, the bottle guide surface 73Ba guides the ink bottle 74 along the bottle guide axis GD inclined to the horizontal plan in the vertical plan including the length direction of the bottle holder 73.

The bottle guide surface 73Ba has first and second end portions along the bottle guide axis GD. The first end portion is opposite to the bottle connecting unit 73C. The second portion is provided with a stopper 73Bb projecting from the bottle guide surface 73Ba. The stopper 73Bb is constructed to contact the bottle body 74C when the ink bottle 74 is removed from the bottle holder 73. Namely, the stopper 73Bb is a resisting part to resist the movement of the ink bottle 74 when the ink bottle 74 is removed. Concretely, the stopper 73Bb is located so as to contact the bottle body 74C when the bottle vent hole 74A and ink outlet 74B are completely removed from the bottle connecting part 73C and the ink bottle 74 is moved to the initial position.

[Bottle connecting unit 73C of Bottle Holder 73]

The bottle connecting unit 73C is means of connecting the bottle vent hole 74A and ink outlet 74B of the ink bottle 74. The bottle connecting unit 73C is constructed to selectively open and close the ink outlet 74B after it is connected. The bottle holder 73 is placed above the image recording unit 40 in the vertical direction. Therefore, the ink in the ink bottle 74 can be replenished to the image recording unit 40 through the bottle connecting tube 2*b* when the ink outlet 74B is opened.

The bottle connecting unit 73C is fixed to the bottom 73A of the bottle holder 73, and placed to connect the ink bottle 74 moved to the first end portion of the bottle guide surface 73Ba. Further, the bottle connecting unit 73C is arranged to face to the front side of the bottle body 74C when the bottle is connected.

The bottle connecting unit 73C has a vent hole connecting part 73E that is connected to the vent hole 74A of the ink bottle 74, an ink outlet connecting part 73F that is connected to the ink outlet 74B, an open/close driving unit 73G to open and close the ink outlet connecting part 73F, a buffer mechanism 73H to absorb a shock when the bottle is connected, and a wireless reading unit 73I.

[Venthole Connecting Part 73E of Bottle Connecting Unit 73C]

As shown in FIG. 3, the enthole connecting part 73E has a center axis parallel to the bottle guide axis GD, and a vent hole bottle facing part 73Ea that is faced to the front side of the bottle body 74C when the ink bottle 74 is connected.

The vent hole connecting part 73E has a vent hole cover 73EB, a vent hole passage 73Ec, a vent hole ink receiving part 73Ed, a vent hole waste ink passage 73Ee, and a vent hole guide 73Ef.

The vent hole cover 73EB is a connecting art to fit with the passage opening part 74AB when the ink bottle 74 is connected. More concretely, the vent hole cover EB fits with the passage opening cover 74Abb when the ink bottle is connected. The vent hole cover is substantially cylindrical, and extends along the bottle guide axis GD from the vent hole bottle facing part 73Ea to the ink bottle 74 when the ink bottle is connected. The cylindrical vent hole cover 73EB is substantially coaxial with the passage opening part 74AB of the bottle vent hole 74A when the bottle is connected, and has substantially the same inside diameter as the outside diameter of the passage opening part 74AB.

Figure 6:
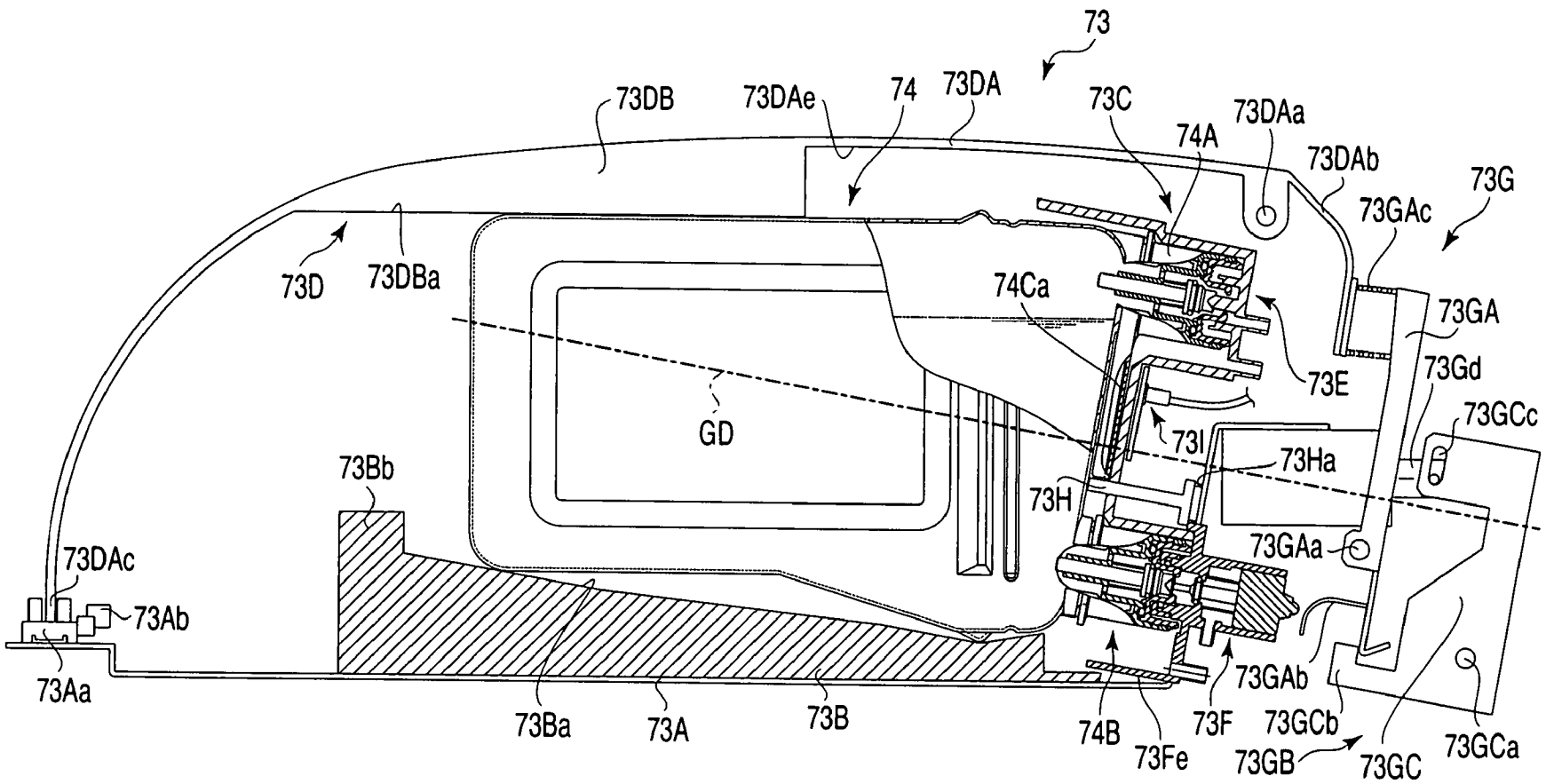
FIG. 6 is a schematic sectional view showing a bottle holder at the completely closed position.
Figure 7:
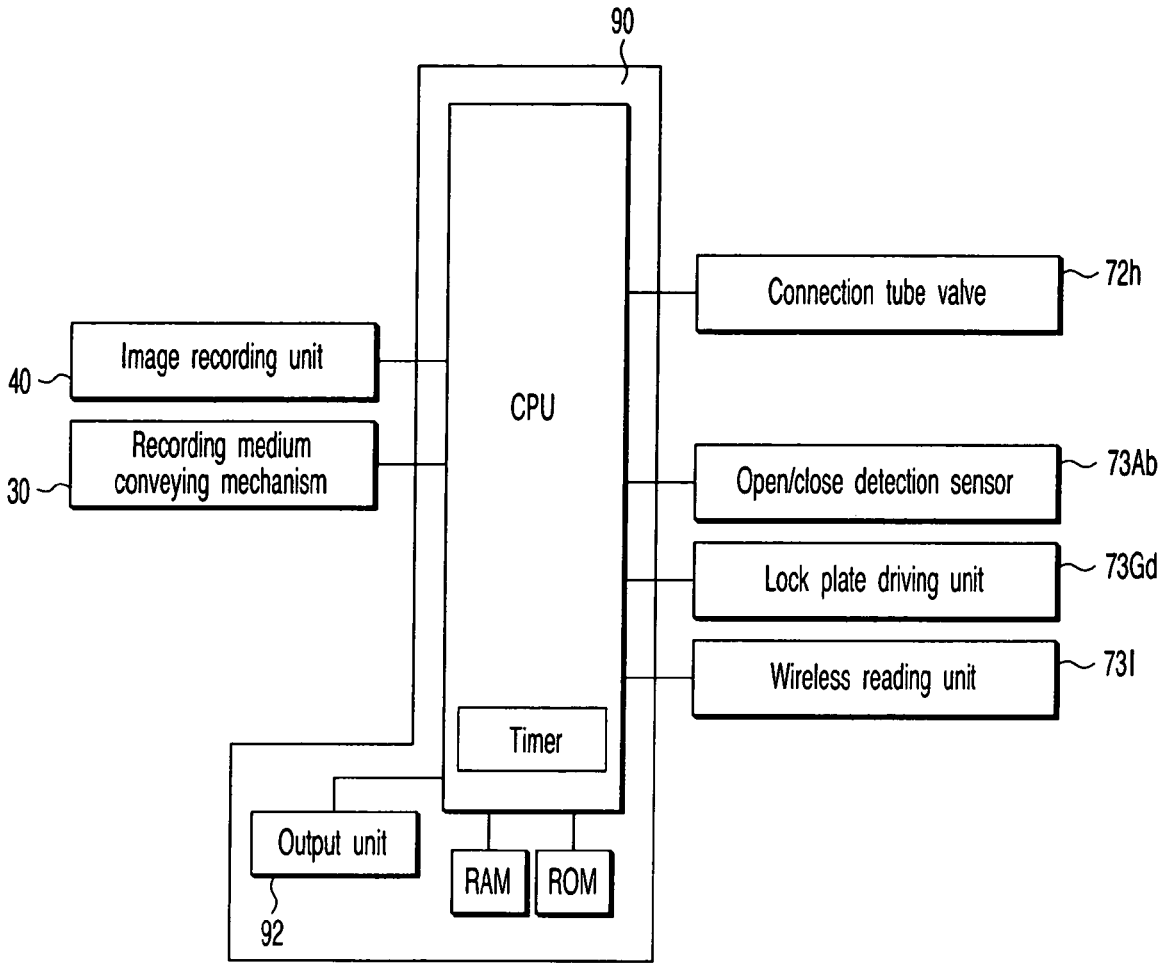
FIG. 7 is a block diagram showing a control unit.

The vent hole cover EB has a cover depression 73EBa to fit with the cover projection 74ABc when the bottle vent hole is completely connected to the vent hole connecting part 73E. The cover depression 73EBa is provided on the internal circumference surface of the vent hole cover EB. The position where the ink bottle 74 is connected to the bottle connecting unit 73C is the connecting position, as shown in FIG. 6.

The cover projection 74ABc and cover depression 73EBa, when fit each other, provides a predetermined resisting force FRa to the direction of pulling the ink bottle 74 from the bottle connecting unit 73C, in the bottle guide axis GD. In other words, the vent hole cover 73EB holds the ink bottle 74, so that the ink bottle 74 is not removed from the bottle connecting unit 73C unless the ink bottle 74 is pulled by the force larger than the resisting force FRa when pulling out the ink bottle 74.

The vent hole cover 73EB has a valve pressing projection 73EBb at the position opposite to the passage opening 74ABa. The valve pressing projection 73EBb extends along the bottle guide axis GD. The valve pressing projection 73EBb has the length to contact the valve member 74ACb in the bottle guide axis GD, before the ink bottle 74 and bottle holder 73 are not completely connected. In other words, the valve pressing projection 73EBb has the length capable of pressing the valve member 74ACb to the bottle body 74C along the bottle guide axis GD when the ink bottle 74 and bottle holder 73 are completely connected. The valve pressing projection 73EBb has the outside diameter smaller than the diameter of the passage opening 74ABa.

The vent hole passage 73Ec is a passage for ventilation for connecting the inside of the vent hole cover 73EB to the outside of the image recording apparatus 1. The vent hole passage 73Ec has one end and the other end. One end is opened to the inside of the vent hole cover 73EB, and the other end is opened to the outside of the image recording apparatus 1.

The vent hole ink receiving part 73Ed is means for preventing contamination of the image recording apparatus 1 when receiving waste ink. The vent hole ink receiving part 73Ed is provided vertically below the bottle vent hole 74A of the ink bottle 74 placed at the initial position. The vent hole ink receiving part 73 extends from the vent hole bottle facing part 73Ea along the bottle guide axis GD. More concretely, the vent hole ink receiving part 73Ed extends from the outside cover end 74ADa to the bottle body 74C in the horizontal direction when the ink bottle 74 is placed at the initial position. More concretely, the outside cover end 74ADa has portions near to and far from the vent hole bottle facing part 73Ea in the horizontal direction (lateral direction in FIG. 3) when the ink bottle 74 placed at the initial position is inclined to the horizontal plan, as shown in FIG. 3. In FIG. 3, the lower side of the outside cover end 74ADa is farther from the vent hole bottle facing part 73Ea than the upper side. The vent hole ink receiving part 73Ed extends to the same position as the farther part (the lower side of the outside cover end 74ADa) or more in the horizontal direction.

The vent hole waste ink passage 73Ee is a passage connected to the vent hole ink receiving part 73Ed and waste ink tank 67, to send the waste ink received by the vent hole ink receiving part 73Ed to the waste ink tank 67.

The vent hole guide 73Ef extends from the vent hole bottle facing part 73Ea along the bottle guide axis GD. The vent hole guide 73Ef slides the opening outside cover 74AD and guides the bottle vent hole 74A along the bottle guide axis GD when the ink bottle 74 is connected.

[Ink Outlet Connecting part 73F of Bottle Connecting Unit 73C]

As shown in FIG. 4, the ink outlet connecting part 73F has a center axis parallel to the bottle guide axis GD, and has an ink outlet bottle facing part 73Fa that is faced to the front side of the bottle body 74C when the ink bottle 74 is connected.

The ink outlet connecting part 74F has an ink outlet opening 73FB, an ink outlet connecting part valve 73FC, an ink outlet passage 73FD, an ink outlet receiving part 73Fe, a waste ink outlet passage 73Ff, and outlet guide 73Fg.

The ink outlet opening 73FB is a connecting part to fit with the passage opening 74BB when the ink bottle 74 is connected. More concretely, the ink outlet opening 73FB fits with the passage opening cover 74BBb when the ink bottle is connected. The ink outlet opening 73FB is connected to the ink outlet passage 73FD, and connects the connected passage opening 74BB to the ink outlet passage 73FD. More concretely, the ink outlet opening 73FB has an outlet passage opening 74FBa, and is connected to the ink outlet passage 73FD through the outlet passage opening 74FBa, as shown in FIG. 4.

The ink outlet opening 73FB is substantially cylindrical, and extends from the ink outlet bottle facing part 73Fa to the ink bottle 74 along the bottle guide axis GD when the ink bottle is connected. The cylindrical ink outlet opening 73FB is substantially coaxial with the passage opening 74BB of the ink outlet 74B, and has substantially the same inside diameter as the outside diameter of the passage opening 74BB when the ink bottle is connected.

The ink outlet opening 73FB has a cover depression 73FBc to fit with the cover projection 74BBc at the connecting position. The cover depression 73FBc is provided in the internal circumference of the ink outlet opening 73FB. The cover projection 74BBc and cover depression 73FBc, when fit each other, provides a predetermined resisting force FRb to the direction of pulling the ink bottle 74 from the bottle connecting unit 73C, in the bottle guide axis GD. In other words, the ink outlet opening 73FB holds the ink bottle 74, so that the ink bottle 74 is not removed from the bottle connecting unit 73C unless the ink bottle 74 is pulled by the force larger than the resisting force FRb when pulling out the ink bottle 74.

As described hereinbefore, when pulling out the ink bottle, the vent hole cover 73EB also provides the resisting force FRa to the pulling direction. Therefore, when removing the ink bottle 74 from the bottle connection part 73C, it is necessary to supply the ink bottle 74 with a force larger than the bottle connecting unit resisting force FRs that is the sum of the resisting forces FRa and FRb.

The ink outlet connecting part valve 73FC is a valve to open and close the ink outlet opening 73FB. The ink outlet connecting part valve 73FC is placed over the ink outlet opening 73FB and ink outlet passage 73FD, along the bottle guide axis GD. The ink outlet connecting part valve 73FC has a valve member 73FCa to close the ink outlet opening 73FB, a pressed member 73FCb to be pressed by the open/close driving unit 73G, and an urging member 73FCc to urge the pressed member 73FCb.

The pressed member 73FCb is placed in the ink outlet passage 73FD, and held by the ink outlet passage 73FD slidably along the bottle guide axis GD. Therefore, the ink outlet connecting part valve 73FC can be moved along the bottle guide axis GD by the guide of the ink outlet passage 73FD. The pressed member 73FCb has substantially the same outside diameter as the inside diameter of the ink outlet passage 73FD, and does leak the ink of the ink outlet passage 73FD from the clearance between the pressed member and the ink outlet passage 73FD.

The urging member 73FCe consists of a coil spring or the like, and is provided in the ink outlet passage 73FD. The urging member 73FCc urges the pressed member 73FCb in the direction of separating from the ink outlet opening 73FB along the bottle guide axis GD.

The valve member 73FCa is placed in the ink outlet opening 73FB, and has the outside diameter larger than the outlet passage opening 73 FBa. The valve member 73FCa is pressed to the outlet passage opening 73 FBa by the urging force of the urging member 73FCc, and closes the outlet passage opening 73 FBa.

The valve member 73FCa has a valve pressing projection 73FBb projecting to the ink bottle 74 when the bottle is connected at the position opposite to the passage opening BBa along the bottle guide axis GD. The length along the bottle guide axis GD of the valve pressing projection 73FBb is set to press the valve member 74BCd when the ink bottle 74 and bottle holder 73 are completely connected and the ink outlet connecting part valve 73FC is pressed to the ink bottle 74. In other words, the valve pressing projection 73FBb is constructed not to press the valve member 74BCb until the ink outlet connecting part valve 73FC is pressed, even if the ink bottle 74 and bottle holder 73 are completely connected. The valve pressing projection 73FBb has the outside diameter smaller than the diameter of the passage opening 74BBa.

The ink outlet passage 73FD, which is connected with the bottle connection tube 72*b*, serves as an ink passage to flow the ink from the ink outlet opening 74FB to the bottle connection tube 72*b*.

The ink outlet receiving part 73Fe is means for preventing contamination of the image recording apparatus 1 when receiving waste ink, and has the same structure as the vent hole ink receiving part 73Ed. Concretely, the outlet ink receiving part 73Fe is provided below in the vertical direction of the ink outlet 74B of the ink bottle 74 placed at the initial position. The outlet ink receiving part 73Fe extends from the ink outlet bottle facing part 73Fa to the bottle body 74C (left side in the drawing) and the outside cover end portion 74BDa of the ink outlet 74B. More concretely, the outlet ink receiving part 73Fe extends to the same position as the part below in the vertical direction of the outside cover end portion 74BDa, or over there in the horizontal direction, as shown in FIG. 4.

Figure 5:
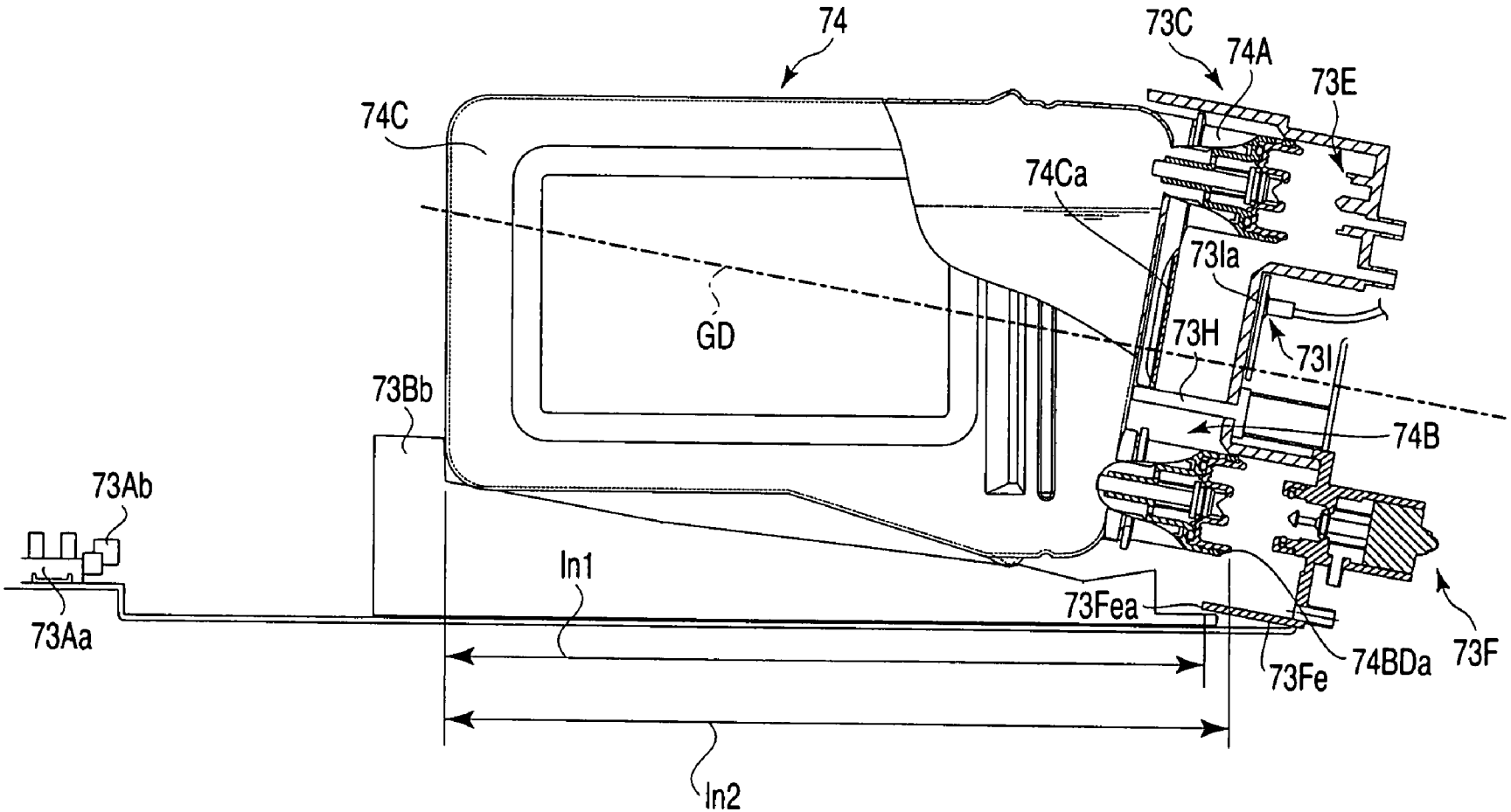
FIG. 5 is a schematic sectional view showing the position of an ink bottle holder to an ink bottle stopped by a stopper.

Now, detail explanation will be given on the arrangement of the outlet ink receiving part 73Fe with reference to FIG. 5. The outlet ink receiving part 73Fe extends along the bottle guide axis GD. The outlet ink receiving part 73Fe has a first end that is connected to the ink outlet bottle facing part 73Fa and a second end 73Fea that is a free end. The second end 73Fea is set so that the distance In1 between the second end 73Fea and the stopper 73Bb is shorter than the distance In2 between the front end of the ink outlet 74 and the stopper 73Bb in the horizontal direction, as shown in FIG. 5. In other words, while the ink bottle 73 is contacting the stopper 73Bb, the second end 73Fea positions nearer to the stopper 73Bb than the outside cover end 74BDa, with respect to the first end of the outlet ink receiving part 73Fe, as shown in FIG. 5.

The outlet waste ink passage 73Ff, which is connected to the outlet ink receiving part 73Fe and waste ink tank 67, serves as a passage to send the waste ink received by the outlet ink receiving part 73Fe to the waste ink tank 67.

The outlet guide 73Fg extends from the ink outlet bottle facing part 73Fa along the bottle guide axis GD. The outlet guide 73Fg slides the opening outside cover 74BD and guides the ink outlet 74B along the guide axis GD when the ink bottle 74 is connected.

[Open/Close Driving Unit 73G of Bottle Connecting Unit 73C]

The open/close driving unit 73G is a valve open/close mechanism to open and close the ink outlet connecting part 73F by moving the ink outlet connecting part valve 73FC. The open/close driving unit 73G has a rotary plate 73GA and a rotary plate lock portion 73GB, as shown in FIG. 2.

The rotary plate 73GA, which is held rotatably by a holder frame (not shown) fixed to the bottom 73A of the bottle holder 73, serves as means for pressing the ink outlet connecting part valve 73FC according to the rotation. The rotary plate 73GA is opposite to the ink outlet connecting part 73F in the bottle guide axis GD. Concretely, the rotary plate 73GA is opposite to the ink bottle 74 connecting side of the ink outlet connecting part 73F.

The rotary plate has first and second ends in the length direction, and is held rotatably by the rotary plate axis 73GAa between the first and second ends. The rotary plate axis 73GAa is a axis parallel to the direction crossing with the length direction (width direction) of the bottle holder 73. The first end of the rotary plate 73GA has an outlet valve pressing portion 73GAb to press the ink outlet connecting part valve 73FC. The second end of the rotary plate 73GA has an urging member 73GAc.

The outlet valve pressing portion 73GAb of is constructed to press the pressed member 73FCb of the ink outlet connecting part valve 73FC when the first end of the rotary plate 73GA is moved to the ink outlet connecting part valve 73FC by the clockwise rotation of the rotary plate 73GA in FIG. 2.

The urging member 73GAc is a coil spring or the like, which is means for urging the second end of the rotary plate 73GA. The urging member 73GAc is constructed to be pressed by the holder cover 73D when the holder cover 73D is closed. The urging member 73GAc urges the rotary plate 73GA, so that the rotary plate 73GA rotates clockwise.

The rotary plate lock portion 73GB is means for locking the rotary plate 73GA. The rotary plate lock portion 73GB has a lock plate 73GC to lock the rotary plate 73GA, and a lock plate driving unit 73Gd to drive the lock plate 73GC.

The lock plate 73GC has first and second ends in the length direction. The lock plate 73GC is placed in the opposite side of the ink outlet connecting part 73F, facing to the rotary plate 73GA. The lock plate 73GC is held rotatably by a lock plate rotation axis 73GCa. The lock plate rotation axis 73GCa is parallel to the rotary plate axis 73GAa. The lock plate 73GC can be moved by the rotation about the lock plate rotation axis 73GCa to the lock position to lock the first end to the rotary plate 73GA, and the release position to release the lock.

A claw 73GCb is provided at the first end of the lock plate 73GC (the end of the lower side in FIG. 2). A connection hole 73GCc, which is a part to connect the lock plate driving unit 73Gd, is provided at the second end of the lock plate 73GC.

The claw 73GCb is constructed to hang on the first end of the rotation plate 73GA at the lock position. The claw 73GCb is hung on the first end of the rotary plate 73GA from the ink outlet connecting part valve 73FC when the rotary plate 73GA is locked. The position of hanging the claw 73GCb on the rotary plate 73GA is set with respect to the lock plate rotation axis 73GCa not to apply the moment of rotation about the lock plate rotation axis 73GCa to the lock plate GC. Concretely, the first end of the rotary plate 73GA moves along the circular orbit about the rotary plate axis 73GAa. The positional relationship between the hanging position of the claw 73GCb and the lock plate rotation axis 73GCa is set, so that the moving direction of the rotary plate 73GA (the tangential direction at the position of the first end on the circular orbit) is located substantially on the axial line connecting the claw 73GCb hanging position and the lock plate rotation axis 73GCa.

The lock plate driving unit 73Gd is means for providing a driving force, such as a solenoid. The lock plate driving unit 73Gd has a driving part to drive in the direction of crossing the radial direction of the lock plate rotation axis 73GCa, and has a projection in the driving part. The projection is inserted into the connection hole 73GCc. The lock plate driving unit 73Gd can rotate the lock plate 73GC about the lock plate rotation axis 73GCa by moving the second end of the lock plate 73GC. Namely, the lock plate driving unit 73Gd can move the first end of the lock plate 73GC to the lock position and release position.

[Buffer Mechanism 73H of Bottle connecting unit 73C]

The buffer mechanism 73H prevents the bottle connecting unit 73C from being exposed to an excessive shock when the ink bottle 74 is connected to the bottle holder 73. The buffer mechanism 73H is fixed to a holder frame extending from the bottom 73A of the bottle holder 73 through an urging member 73Ha such as a coil spring. The buffer mechanism 73H is guided by the holder frame to move along the bottle guide axis GD. The buffer mechanism 73H projects to the ink bottle 74 from the vent hole connecting part 73E and ink outlet connecting part 73F, along the bottle guide axis GD. The buffer mechanism 73H is urged by the urging member 73Ha toward the ink bottle side along the bottle guide axis GD when the bottle is connected. Namely, the urging member 73Ha urges the buffer mechanism 73H in the direction of releasing the connection of the ink bottle 74 and bottle holder 73. The bottle urging force FUa of the urging member 73Ha is set to the value capable of pushing back the ink bottle filled with ink. Therefore, the ink bottle 74 is pressed by the buffer mechanism 73H and returned to the initial position when it is placed in the bottle holder 73. The bottle urging force FUa is set to the value smaller than the bottle connecting unit resisting force FRs. In other words, the bottle urging force FUa is set smaller than the holding force of the bottle holder 73 to hold the ink bottle 74. Namely, the buffer mechanism 73H does not release the completely connected ink bottle 74 from the bottle connecting unit 73C by the bottle urging force FUa.

[Wireless Reading Unit 73I of Bottle Connecting Unit 73C]

The wireless reading unit 73I is an identify sensor to read the information of an ink label 74Ca without contacting the label. The wireless reading unit 73I has an antenna 31*a* to read the information of the ink label 74Ca. The antenna 31*a* is placed at the position opposite to the ink label 74Ca when the ink bottle 74 is connected to the bottle connecting unit 73C. The wireless reading unit 73I is connected to the control unit 90, and sends the control unit 90 the information read from the ink label 74Ca. The wireless reading unit 73I can be replaced by another wireless reading unit capable of writing information to the ink label 74Ca.

[Holder Cover 73D of Bottle Holder 73]

The holder cover 73D is an openable cover to cover the whole bottle holder 73. The holder cover 73D has a cover body 73DA to cover the whole bottle holder 73, and a cover rib 73DB placed inside the cover body. FIG. 2 shows the holder cover 73D at the opened position.

The cover body 73DA has first and second ends, and rotatable about a cover rotation axis 73DAa placed between the first and second ends. The cover rotation axis 73DAa is parallel to the rotary plate axis 73GAa. The holder cover 73D can be moved to the opened position and completely closed position by the rotation about the cover rotation axis 73DAa. The cover body 73DA has a cover bottle facing surface 73DAe opposite to the ink bottle 74 placed in the bottle holder 73.

The first end of the cover body 73DA has an urging member pressing portion to press the urging member 73GGc of the rotary plate 73GA. The urging member pressing portion 73DAb contacts the urging member 73GAc when the holder cover is opened, as shown in FIG. 2. When the holder cover 73 is moved from the opened position to the completely closed position, the urging member pressing portion 73DAb rotates counterclockwise about the cover rotation axis 73DAa. As a result, the urging member pressing portion 73DAb is moved to the urging member 73GAc.

The second end 73DBc of the cover body 73DA is constructed to come in contact with the bottom 73A of the bottle holder 73 at the completely closed position. At the opened position, the second end 73DAc of the cover body 73DA is placed at the position separated a predetermined distance from the bottom 73A. The separation distance is set to the degree to make the ink bottle 74 removable from between the second end 73DAc and bottom 73A.

The bottom 73A of the bottle holder 73 has a cover connecting portion 73Aa that is connected to the second end 73DAc at the completely closed position. The cover connecting portion 73Aa holds the second end 73DAc at the completely closed position, and prevents undesired opening of the bottle holder 73. The cover connecting portion 73Aa is provided with an open/close detection sensor 73Ab that is a cover sensor to detect the opening/closing of the cover. The open/close detection sensor 73Ab is detecting means or a detector to detect that the second end 73DAc is connected to the cover connecting portion 73Aa. The open/close detection sensor 73Ab is connected to the control unit 90, and sends the detection result to the control unit 90.

The cover rib 73DB is placed oppositely to the ink bottle 74 placed in the bottle holder 73, at the completely closed position. The cover rib 73DB projects from the inside of the cover body 73DA (the cover bottle facing surface 73DAe). The cover rib 73DB has a rib bottle facing surface 73Dba opposite to the ink bottle 74, at the completely closed position.

The rib bottle facing surface 73Dba is placed at the same position as the upper surface of the ink bottle 74 placed at the connecting position at the time of closing, in the normal line direction of the bottom 73A (in the vertical direction in FIG. 2 and FIG. 6). The position of the upper surface of the ink bottle 74 is different in the normal line direction, at the initial position (refer to FIG. 2) and the connecting position (refer to FIG. 6). Concretely, the upper surface of the ink bottle 74 is located at a high position compared with the connecting position when the ink bottle 74 is placed at the positions other than the connecting position. Therefore, when the ink bottle 74 is placed at the positions other than the connecting position, the cover rib 73DB hits upon the upper surface of the ink bottle 74, and the holder cover 73D cannot be moved to the completely closed position. The cover rib 73DB prevents the holder cover 73D from reaching the completely closed position before the ink bottle 74 is completely connected to the bottle connecting unit 73C.

[Control Unit 90]

The control unit 90 consists of a computer including a CPU, a timer, a ROM, a RAM, and output unit 92. The control unit 90 is connected to the image recording mechanism 20 and ink supply unit 70, and controls the driving of these parts.

The control unit 90 is further connected to the connection tube valve 72*h*, open/close detection sensor 73Ab, lock plate driving unit 73Gd, and wireless reading unit 73I, in the ink supply unit, and controls the driving of these parts.

The control unit 90 informs the user of an error message or the like from an output unit 92. That is, the output unit 92 is an informing unit to inform the user of information.

[Operation for Fitting Ink Bottle]

The ink bottle 74 is set in the corresponding bottle holder 73. In this time, the ink bottle 74 is first placed at the initial position on the bottle guide surface 73Ba by the user. The ink bottle 74 is connected to the bottle connecting unit 73 by the user by being pressed from the initial position to the bottle connecting unit 73C along the guide of the bottle guide surface 73Ba, and placed at the connecting position. The ink bottle 74 can be moved to the bottle connecting unit 73C by the user by being pressed to the connecting position by the force larger than the bottle urging force FUa of the buffer mechanism 73H. When the cover projection 74ABc and cover projection 74BBc fit with the corresponding cover depression 73EBa and cover depression 73FBc, the connection of the ink bottle 74 to the bottle holder 73 is completed. When the ink bottle 74 is completely connected to the bottle holder 73, the cover projection 74ABc and cover projection 74BBc fit with the cover depression 73EBa and cover depression 73FBc with a click noise. By this click noise, the user can know completion of the connection of these parts.

When the connection is completed, the wireless reading unit 73I reads the label information that is the information of the ink label 74Ca of the ink bottle 74. The label information is stored in the RAM. The control unit 90 has in the ROM the information corresponding to the ink bottle 74 to be connected to each bottle holder 73. In this embodiment, the color of the ink bottle 74 is set in the information corresponding to each bottle holder 73. The control unit 90 compares the label information with the information of the corresponding bottle holder 73, and checks whether the specified ink bottle 74 is connected to the corresponding bottle holder 73. When the correct ink bottle 74 is not connected to the corresponding bottle holder 73, the control unit 90 causes the output unit 92 or the informing unit to give an audible alarm and display an error message. Further, when the ink bottle 74 is not set in the suitable bottle holder 73, the control unit 90 judges that an unsuitable ink bottle is set in the bottle holder, and does not drive the open/close driving unit 73G that is a valve open/close mechanism. When the connection is completed, the passage valve 74AC of the bottle vent hole 74A of the ink bottle 74 is opened, but the ink outlet 74B is not opened.

When the connection is not completed with the ink bottle located between the initial position and the connecting position, the ink bottle 74 is returned to the initial position by the buffer mechanism 73H. When the ink bottle 74 is located at a position other than the connecting position on the bottle guide surface 73Ba, the cover rib 73DB interferes with the ink bottle 74 as shown in FIG. 2, and the holder cover 73D cannot be closed. In other words, at least a part of the ink bottle 74 located at a position other than the connecting position is placed on the path of moving the holder cover 73D to the completely closed position, and directly interrupts the closing of the holder cover 73D. If there is even one ink bottle that is not placed at the connecting position, the holder cover 73D cannot be placed at the completely closed position. The user can know the incomplete connection from the failure of closing the holder cover 73D.

When the holder cover 73D is moved to the completely closed position, the urging member 73GAc is pressed by the urging member pressing portion 73DAb, but the pressed urging member 73GAc is compressed because the clockwise rotation of the rotary plate 73GA is regulated by the lock plate 73GC.

After all ink bottles 74 are connected to the bottle holder 73, the holder cover 73D is closed by the user and moved to the completely closed position, as shown in FIG. 6. When the holder cover 73D is moved to the completely closed position, the open/close detection sensor 73Ab detects the holder cover 73D.

When the predetermined ink bottle 74 is completely connected to the bottle connecting units 73C of all bottle holders 73, and the holder cover 73D is placed at the completely closed position, the fitting of the ink bottle 74 to the bottle holder 73 is completed.

Then, the control unit 90 starts counting the time elapsed after receiving the signal from the open/close detection sensor 73Ab. The control unit 90 stores in the ROM the standby time t1 from the reception of the signal from the open/close detection sensor 73Ab to the opening of the ink outlet connecting part valve 73FC. When the ink bottle 74 is moved during conveying, the ink in the ink bottle 74 is stirred and bubbles are mixed. The standby time t1 can be set to a desired value, preferably the time necessary to separate the bubble from the ink to the extent usable for recording an image. When the counted time reaches the standby time t1, the control unit 90 emits a press driving instruction signal to the open/close driving unit 73G to press the ink outlet connecting part valve 73FC.

Figure 8:
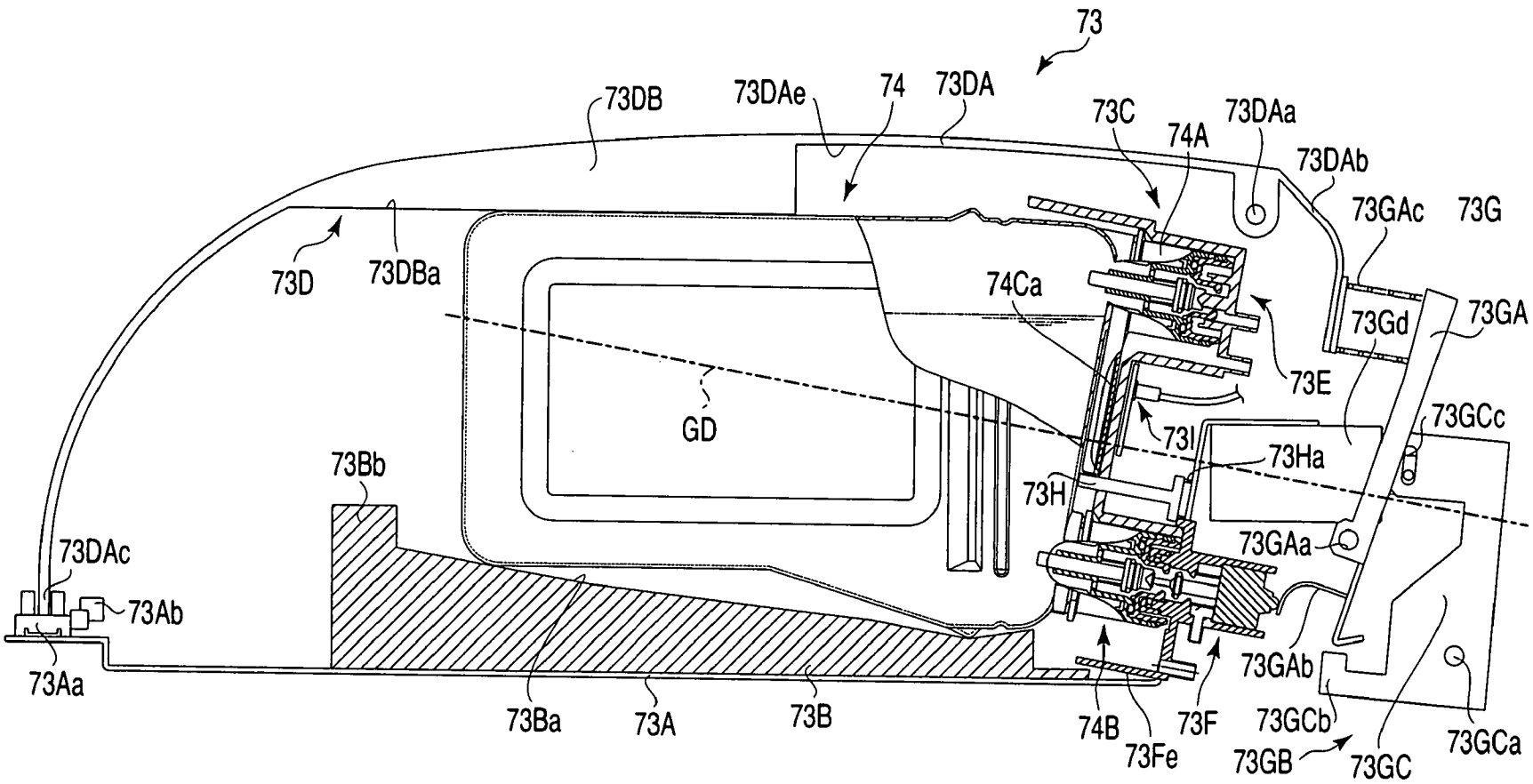
FIG. 8 is a schematic sectional view showing a driven open/close driving unit.

Receiving the press driving instruction, the open/close driving unit 73G drives the lock plate driving unit 73Gd and rotates the lock plate 73GC counterclockwise. When the lock plate 73GC is rotated, the claw 73GCb is released from the first end of the rotary plate 73GA, as shown in FIG. 8. The rotation of the rotary plate 73GA is controlled by the claw 73GCb and located at the initial position, as shown in FIG. 6. At the initial position, the rotary plate 73GA is separated from the ink outlet connecting part valve 73FC.

When the claw 73GCb is released by the rotation of the lock plate 73GC, the rotary plate 73GA is released from the clockwise rotation control, and rotated clockwise from the initial position by the urging force of the urging member 73GAc. By this rotation, the outlet valve pressing portion 73GAb presses the pressed member 73FCb of the ink outlet connecting part valve 73FC. By this pressing, the ink outlet connecting part valve 73FC is opened, and the ink outlet connecting part 73F can flow the ink. The ink outlet connecting valve 73FC presses the passage valve 74BC that is a valve of the ink outlet 74B, by the pressing force of the outlet valve pressing portion 73GAb. By this pressing, the ink bottle 74 can flow the ink from the ink outlet 74B. Thus, the ink bottle 74 is connected to the bottle connection tube 72*b* through the ink outlet 74B and ink outlet connecting part 73F.

When the suitable ink bottle 74 is connected to each bottle holder 73, the image recording apparatus 1 permits the supplying of ink from the ink bottle 73, and opens the connection tube valve 72*h*. As a result, the ink of the ink bottle 74 flows into the image recording unit 40, and the ink replenishment is completed.

[Image Recording Operation]

When recording an image with the image recording apparatus 1, the control unit 90 sends a recording medium conveying instruction to the recording medium conveying mechanism. Based on this instruction, the control unit 90 sends a driving instruction to the image recording unit 40, and causes the unit to eject ink to the conveyed recording medium. In this way, the image recording apparatus 1 records a desired image on a recording medium.

[Ink Bottle Removing Operation]

The ink bottle 74 is removed from the bottle holder 73 when it is replaced. When the user opens the holder cover 73D for removing the ink bottle 74, the open/close detection sensor 73Ab detects the opening of the cover 73D and outputs an opening detection signal. The control unit 90 receives the signal, and sends a separation driving instruction to the open/close driving unit 73G of all bottle holders 73, to separate the outlet valve pressing portion 73GAb.

The open/close driving unit 73G receives the separation driving instruction signal, and drives the lock plate driving unit 73Gd, rotates the lock plate 73GC, hangs the claw 73GCb on the rotary plate 73GA, and return the rotary plate 73GA to the initial position. Thus, the ink outlet connecting part valve 73FC is released from the pressing by the outlet valve pressing portion 73GAb. When the pressing is released, the ink outlet connecting part valve 73FC closes the outlet passage opening 73 FBa, and the passage valve 74BC closes the passage opening 74BBa. When the ink outlet connecting part valves 73FC of all bottle holders 73 are completely closed, the control unit 90 informs the user that the ink bottle can be removed, through the output unit 92. It is possible to detect the completion of the closing by picking up the state of the open/close driving unit 73G, or by directly picking up the closing of the ink outlet connecting part valve 73FC that is the valve of the bottle connecting unit 73C, or the passage valve 74Ac that is the ink outlet valve.

After the outlet passage opening 73FBa and passage opening 74BBa are closed, the ink bottle 74 is removed from the bottle holder 73. The ink bottle 74 is removed from the bottle holder 73 when it is pulled along the bottle guide axis GD by the force larger than the bottle connecting unit resisting force FRs. When the ink bottle 73 is removed, it comes in contact with the stopper 73Bb and stops at the initial position, as shown in FIG. 2. Namely, the stopper 73Ba prevents further movement of the ink bottle 74 in the removing direction along the bottle guide axis GD. The ink bottle 74 can shake off the ink adhered to the front end of the opening outside cover 74BD into the outlet ink receiving part. Then, the ink bottle 74 is removed from the bottle holder 73.

In this embodiment, when the ink bottle 74 is removed from the bottle holder 73, the force in the bottle removing direction is stopped by the stopper 73Bb that is a resisting part. This prevents the ink bottle 74 from moving strongly all over the bottle guide surface, and can prevent splashing of the ink over the whole bottle guide surface. In this embodiment, the stopper 73Bb projects from the bottle guide surface 73Ba to the height capable of stopping the ink bottle 74 when it is removed. The stopper 73 may be a projection of the degree of decreasing the force in the direction of removing the ink bottle 74. As long as the force in the direction of removing the ink bottle 74 can be decreased, the stopper 73Bb can be formed not to substantially project, by using a member with the friction coefficient higher than the bottle guide surface 73Ba. Further, the stopper 73Bb can be constructed to decrease the force of the ink bottle 74 by using a magnetic power. In this case, the ink bottle 74 is constructed to have a magnetic body. The stopper 73Bb is not limited in the structure, as long as it can decrease or stop the force of moving the ink bottle 74 when it is removed.

The ink bottle moving speed changes upon contacting with the stopper 73Bb when removed. Thus, the ink adhered around the ink outlet 74B can be shaken off. Therefore, the ink outlet can be prevented from being stained with the ink.

The outlet ink receiving-part 73Fe is located so as to be position below the ink outlet 74B when the ink bottle comes in contact with the resisting part. Therefore, the outlet ink receiving part 73Fe securely receives the ink shaken off from the ink outlet 74B, and prevents contamination of the inside of the image recording apparatus. Particularly, in this embodiment, the outlet ink receiving part 73Fe extends over the front end of the ink outlet 74B in the horizontal direction toward the side that the second end separates from the first end. More concretely, the second end of the outlet ink receiving part 73Fe is placed to the stopper 73Bb in the horizontal direction exceeding the opening delimited by the opening outside cover 74BD that is the opening at the front end of the ink outlet 74. Therefore, the outlet ink receiving part 73Fe can securely receive the ink shaken off from the front end of the ink outlet 74B.

In this embodiment, the ink outlet receiving part 73Fe is an ink pan that brings the received waste ink to the waste ink bottle 67. It is also possible to use a member to absorb the received ink. For example, porous material may be used for the absorbing member. It is permitted to use any known member as long as it can absorb the ink.

The control unit 90 can control the opening/closing of the valve of the ink outlet 74B at a desired timing, by controlling the open/close driving unit 73G. The control unit 90 opens the ink outlet 74B by driving the open/close driving unit 73G in the predetermined standby time t1 after the detection. By this control, the image recording apparatus 1 can prevent the flowing of the ink in the ink bottle and the ink separated from bubbles and mixed with many bubbles into the ink supply unit within the standby time t1. Namely, the image recording apparatus 1 can prevent the flowing of the ink not in the recordable state to the ink supply unit.

The control unit 90 can detect the closing of the holder cover 73D by the open/close detection sensor 73Ab. Therefore, the image recording apparatus 1 can securely confirm the connection of the ink bottle 74 to the bottle holder 73.

The control 90 can securely confirm that a correct ink bottle 74 is fit in the bottle holder 73, from the label information read by the wireless reading unit 73I. Therefore, the image recording apparatus 1 can prevent misfit of the ink bottle 74. Particularly, in the image recording apparatus of this embodiment, the kind of ink is recorded on the ink label 74Ca, and the ink bottle 74 containing a correct kind of ink can be fit in the bottle holder 73.

The control unit 90 can read the information of the ink label 74Ca without contacting the label. Therefore, the image recording apparatus 1 can prevent the ink label 74Ca reading unit from being stained with the ink adhered to the ink bottle.

The bottle holder 73 may be provided with a temperature detector or means for detecting the temperature of the ink in the ink bottle. In this case, the control unit 90 can know the ink temperature from the temperature detector or temperature detection means and control the open/close driving unit 73G to open the ink outlet when the temperature reaches the image recordable level. Thus, the image recording apparatus 1 can prevent the flowing of ink into the ink supply unit 70 before the temperature of the ink reaches the image recordable temperature. The temperature detector or temperature detection means consists of a thermistor, for example. But, it is not limited to a thermistor, and any other known temperature detector can be used.

In this embodiment, the resisting force FRa is provided by the fitting of the cover projection 74ABc with the cover depression 73EBa. But, it is possible to provide the resisting force by using a sealing member such as an O-ring to make airtight connection of the bottle vent hole 74A and vent hole connecting part 73E. The resisting force FRb can be provided by a sealing member to make airtight connection of the bottle vent hole 74A and vent hole connecting part 73E. In this case, it is possible to omit the cover projections 74ABc/74BBc and cover depression 73EBa/73FBc.

The embodiments of the present invention have been described hereinbefore with reference to the drawings. However, the present invention is not limited to the above embodiments, and includes all embodiments made without departing from the spirit and scope of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus, comprising:

an image recording unit that records an image by ejecting ink;

an ink supply unit that connects at least one ink bottle containing ink for recording the image to the image recording unit, wherein the ink bottle has an ink outlet to flow out the ink, the ink outlet has a valve that is openable and closable, and the ink supply unit includes a bottle holder to hold the ink bottle removably, a detector to detect that the ink bottle is placed at a proper position in the bottle holder, and a valve open/close mechanism to open and close the valve of the ink outlet; and a control unit that controls the driving of the ink supply unit, wherein the control unit drives the valve open/ close mechanism to open the valve of the ink outlet of the ink bottle after a predetermined time has passed from receiving a detection signal from the detector;

wherein the ink supply unit has an open/close cover placed at a completely closed position when the ink bottle is fit at the proper position in the bottle holder, and the detector has a cover sensor to detect that the cover is placed at the completely closed position.

2. The image recording apparatus according to claim 1, wherein the ink supply unit has a distinguish sensor that distinguishes whether the ink bottle fit in a given bottle holder is suitable, and the control unit does not drive the valve open/close mechanism to open the valve of the outlet of the ink bottle when judging that an unsuitable ink bottle is fit in the bottle holder based on an output from the distinguish sensor.

3. The image recording apparatus according to claim 2, further comprising an informing unit to inform a user of an error, wherein the control unit informs the user of an ink bottle fitting error through the informing unit based on the output from the distinguish sensor.

4. The image recording apparatus according to claim 1, wherein the ink supply unit connects a plurality of ink bottles to the image recording unit, and the cover is constructed not to be placed at the completely closed position when even one of the ink bottles is not placed at the proper position.

5. The image recording apparatus according to claim 1, wherein the proper position of the ink bottle to the cover is set so that the ink bottle does not interrupt movement of the cover to the completely closed position when placed at the proper position in the bottle holder, and wherein when the ink bottle is place in the bottle holder at an improper position the ink bottle is located on a moving trace of the cover to the completely closed position to directly interrupt closing of the cover.

6. The image recording apparatus according to claim 1, wherein the control unit immediately drives the valve open/close mechanism to close the valve of the ink outlet of the ink bottle in response to an output from the cover sensor when the cover is released from the completely closed position.

7. The image recording apparatus according to claim 6, further comprising an informing unit which informs a user of removal of the ink bottle when the valve of the ink outlet is completely closed.

8. An image recording apparatus comprising:

an image recording unit that records an image by ejecting ink;

an ink supply unit that connects at least one ink bottle containing ink for recording the image to the image recording unit, wherein the ink bottle has an ink outlet to flow out the ink, the ink outlet has a valve that is openable and closable, and the ink supply unit includes a bottle holder to hold the ink bottle removably, a detector to detect that the ink bottle is placed at a proper position in the bottle holder, and a valve open/close mechanism to open and close the valve of the ink outlet;

a control unit that controls the driving of the ink supply unit, wherein the control unit drives the valve open/close mechanism to open the valve of the ink outlet of the ink bottle after a predetermined time has passed from receiving a detection signal from the detector; and a temperature detector that detects a temperature of the ink in the ink bottle placed at the proper position in the bottle holder, wherein the control unit sets the time from reception of the detection signal from the detector to the opening of the valve of the ink outlet based on a detection result of the temperature detector.

* * * * *